United States Patent [19]

Phillips

[11] Patent Number: 4,584,952

[45] Date of Patent: Apr. 29, 1986

[54] SEWING DEVICE

[76] Inventor: Dollie T. Phillips, 2327 W. McMicken Ave., Cincinnati, Ohio 45214

[21] Appl. No.: 678,276

[22] Filed: Dec. 5, 1984

[51] Int. Cl.[4] ..... D05B 35/00; D06C 15/00; B25B 5/00

[52] U.S. Cl. ..... 112/148; 223/61; 269/208

[58] Field of Search ..... 112/148, 150, 151, 152, 112/149, 121.26; 223/61, 63, 95, 96; 38/102.1; 269/207, 208, 215; 24/580, 584, 612; 248/188.5, 418

[56] References Cited

U.S. PATENT DOCUMENTS

| | | | |
|---|---|---|---|
| 633,050 | 9/1899 | Spenard . | |
| 748,131 | 12/1903 | Winterbotham . | |
| 907,321 | 12/1908 | Davis | 223/96 |
| 2,273,791 | 2/1942 | Wirgin | 248/188.5 |
| 2,610,596 | 9/1952 | Zygmunt | 112/121.26 |
| 2,638,067 | 5/1953 | Cozart, Jr. . | |
| 2,835,421 | 5/1958 | Marchese . | |
| 2,922,554 | 1/1960 | Zauncosky et al. | 223/61 |
| 3,089,691 | 5/1963 | Berry . | |
| 3,474,943 | 10/1969 | McBain et al. | 223/95 |
| 3,542,262 | 11/1970 | Ewert . | |
| 3,704,850 | 12/1972 | Hendrickson et al. | 248/188.5 |
| 3,712,652 | 1/1973 | Uilkema | 248/188.5 |
| 3,790,043 | 2/1974 | Hagen | 223/61 |
| 3,811,455 | 5/1974 | Thur | 248/188.5 |

*Primary Examiner*—Werner H. Schroeder
*Assistant Examiner*—Joseph S. Machuga
*Attorney, Agent, or Firm*—Wood, Herron & Evans

[57] ABSTRACT

A sewing device for sewing an elastic band to cloth. The sewing device includes a pair of spaced fingers slidably connected one with the other, a spring-loaded pin fixed to one finger's slide bar that cooperates with one of a series of holes in the finger's slide bar to hold the fingers in desired spaced relation, and a removable spring clip that cooperates with each of the fingers to hold an elastic band in connected relation with those fingers when desired. In use, and with the fingers spaced a minimum distance one from the other, the elastic band is laid over the fingers and connected thereto by the spring clips. The spring-loaded pin on one slide bar is then depressed to move it out of a hole in the other slide bar, the slide bars thereafter being moved relative one to the other until the fingers are spaced that distance which provides the desired stretch in the elastic band. The spring-loaded pin is then received in another of the spaced holes of the other slide bar to maintain that desired stretch in elastic band. The stretched elastic band is then sewn, while in its stretch condition, to the cloth.

3 Claims, 2 Drawing Figures

SEWING DEVICE

This invention relates to sewing devices. More particularly, this invention relates to a sewing device for sewing elastic to cloth.

In stitching an elastic band to cloth so that the cloth is gathered when the band is not stretched out, the elastic band must held in the stretched condition as it is sewn to the cloth. When so held, and after being stitched to the cloth, the elastic band shortens or gathers the length of the cloth to which it was sewn as the elastic band is released and as it returns to its non-stretched condition. The sewing of an elastic band to the cloth is particularly necessary in the repair of, e.g., children's garments, where a worn out or over stretched elastic bank must be repaired or replaced. But the problem to which this invention is directed occurs not only in the home repair of garments, it also occurs in the original manufacture of garments, where an elastic band must be sewn or attached to the garment.

Accordingly, it has been the primary objective of this invention to provide a sewing device for sewing an elastic band to cloth. The sewing device includes a pair of spaced fingers slidably connected one with the other, a spring-loaded pin fixed to one finger's slide bar that cooperates with one of a series of holes in the other finger's slide bar to hold the fingers in desired spaced relation, and a removable spring clip that cooperates with each of the fingers to hold an elastic band in connected relation with those fingers when desired. In use, and with the fingers spaced a minimum distance one from the other, the elastic band is laid over the fingers and connected thereto by the spring clips. The spring-loaded pin on one slide bar is then depressed to move it out of a hole in the other slide bar, the slide bars thereafter being moved relative one to the other until the fingers are spaced that distance which provides the desired stretch in the elastic band. The spring-loaded pin is then received in another of the spaced holes of the other slide bar to maintain that desired stretch in elastic band. The stretched elastic band is then sewn, while in its stretch condition, to the cloth.

Figure 1:
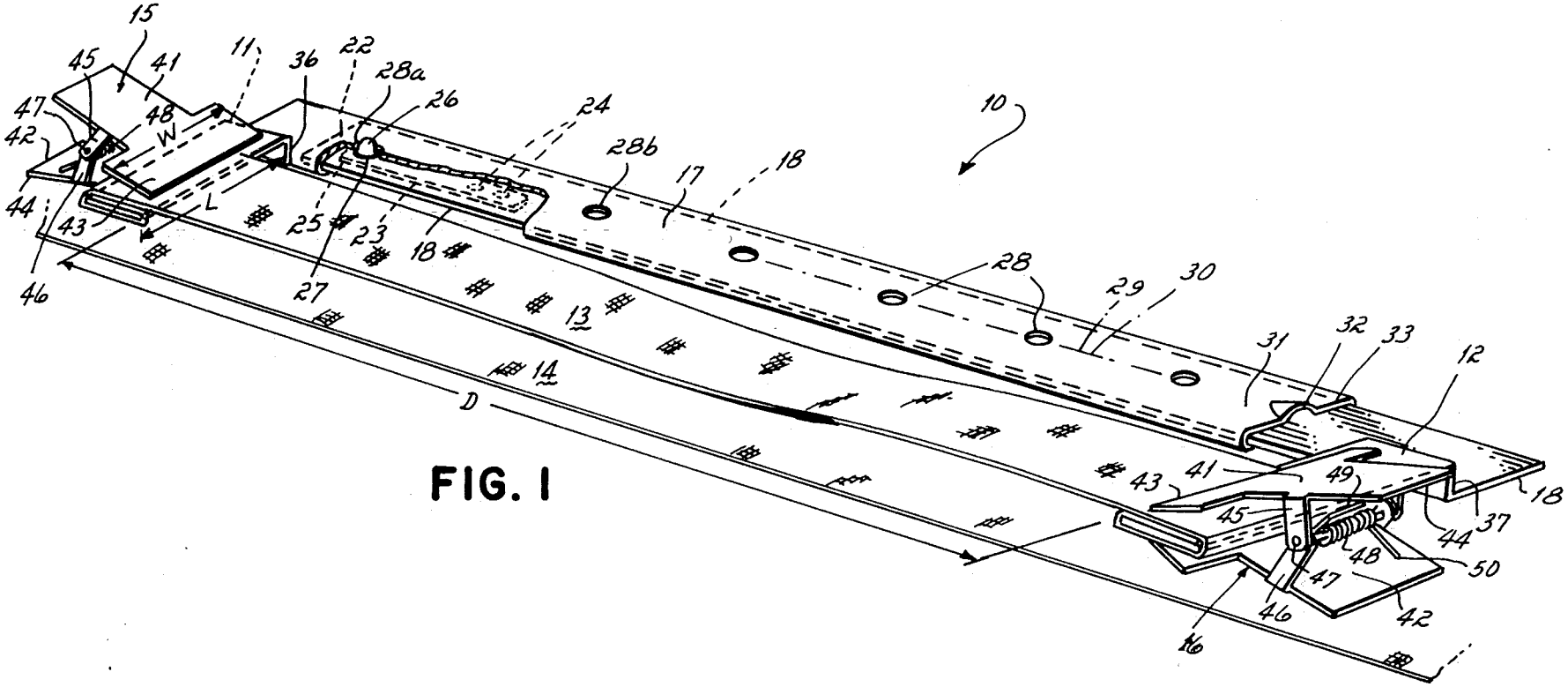
Figure 2:
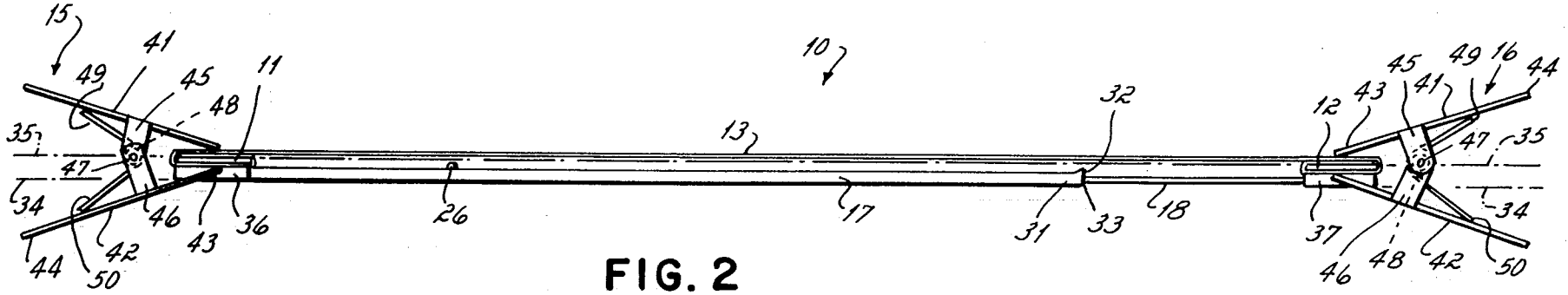

Other objectives and advantages will be more apparent from the following detailed description taken in conjunction with the drawings in which:

FIG. 1 is a perspective view of a sewing device in accord with the principles of this invention, the device being shown in an elastic band as installed but unstretched position; and FIG. 2 is a view of the sewing device showing the device in a band-stretched position.

The sewing device 10 of this invention includes a pair of fingers 11, 12 spaced one from the other, the fingers being generally parallel one to the other. An elastic band 13 to be sewn to a piece of cloth 14 is wrapped unstretched around each of the fingers 11, 12, and is held thereto by separate spring clips 15, 16 that are removable from the fingers.

Each of the fingers 11, 12 is connected to a slide bar 17, 18 respectively. The slide bar 17 fixed to finger 11 is of a generally channel-shaped cross sectioned configuration, as shown in FIG. 1, and is adapted to receive linear slide bar 18 fixed to finger 12 in a telescoping relationship. The slide bars 17, 18 and fingers 11, 12, in assembled relation, as shown on FIG. 1, take on a generally U-shaped configuration with the base of the U-shaped configuration being constituted by the telescoping slide bars. The free end 22 of slide bar 18 is provided with a leaf spring 23 fixed to the underside thereof by rivets 24. The free or flexible end 25 of the leaf spring carries a pin 26 that extends through hole 27 in that slide bar 18. The other slide bar 17 is provided with a series of holes 28 therethrough. The holes 28 are aligned on a common line 29 that is common with this sliding axis 30 of the slide bars 17, 18. The spring-loaded pin 26 carried by slide bar 18 is receivable in any one of the holes 28 of slide bar 17. The linear distance D between fingers 11, 12 is established, and is held fixed, by the interconnection of leaf spring pin 26 with the desired hole 28 in slide bar 17. Note that at the free end 31 of the slide bar 17 there is a notch 32 in that free end's edge 33. The notch 32 cooperates with the springloaded pin 26 to aid the device's user in assembling slide bar 17 with slide bar 18 if these two elements are disconnected one from the other.

The two slide bars 17, 18 are basically coplanar one with the other same being slidable in plane 34. The two fingers 11, 12 similarly, are also in a generally common plane 35, but the finger plane 35 is offset from the slide bar plane 34. As shown in FIG. 2, the two fingers 11, 12 are offset from slide bar plane by webs 36, 37. This offset relationship of the fingers 11, 12 and slide bars 17, 18 permits the distance D between the fingers to be easily adjusted when the device is being used with a sewing machine by a seamstress.

Each of the spring-loaded clips 15, 16 is comprised of two separate clip members 41, 42. Each of the clip members 41, 42 includes a jaw section 43 and a lever plate section 44. And those members 41, 42 are pivotally connected one with the other by ears 45,46 and pivot pin 47. Coil spring 48 received on the pivot pin 47 has one end 49 that bears against lever plate section 44 of member 41, and another end 50 that bears against lever plate section 44 of member 42, thereby continuously biasing those two members into the jaw closed position as shown in FIG. 1. Each of these spring-loaded clips 15, 16 is easily removable from, and reconnectable with, a finger 11, 12 of the sewing device 10. In this regard, note that the jaw width W of each spring-loaded clip 15, 16 is substantially equal to the length L of its associated finger 11 or 12.

In use, and when it is desired to sew an elastic band 13 to a piece of cloth 14, the slide bars 17, 18 of the sewing device 10 are initially adjusted so that the fingers 11, 12 are at the minimum distance D one from the other. That adjustment is achieved, of course, by depressing leaf spring pin 26 out of its slide bar hole 28, and then moving or telescoping slide bars 17, 18 into minimum distance position where the pin is received in aperture **28*a*. With the device so initially adjusted, one end of the elastic band 13 is wrapped around finger 11 and held thereto by spring clip 15, and the other end of the elastic band is wrapped around finger 12 and held thereto by spring clip 16**, the initial tautness of the elastic band between the fingers being such that it is taut but not significantly stretched.

Subsequently, the slide bar's spring pin 26 is depressed by the thumb of one of the user's hands out of hole **28*a*, and the user's other hand then draws the finger 12 away from the finger 11, i.e., the slide bars 17, 18 are telescoped away from one another. This step is carried out until the desired stretch is induced in the elastic band 13 connected to the fingers 11, 12 by the spring clips 15, 16. When the desired stretch in the elastic band 13 has been achieved, then the spring pin 26** is permitted to relocate in the desired hole 28*b* of slide bar 17. The elastic band 13 is now stretched to the desired tautness, and can be easily sewn to the piece of cloth 14 through use of a sewing machine, not shown. After the stretched elastic band 13 has been sewn to the cloth 14, the band is released from the device's fingers 11, 12 simply by removing spring clips 15, 16. This, of course, permits the elastic band 13 to return to its unstretched length which, in turn, causes the material to which it has been sewn to be gathered together as desired.

The sewing device of this invention is excellent for replacing damaged elastic bands in used garments, as well as for attaching new elastic bands in newly-made garments at the place of manufacture. Also, the sewing device is quite useful to hold hard-to-handle elastic when basting or stitching difficult areas of garment seams. And importantly, there are no pins temporarily used for piercing the elastic band as it is sewn to the cloth. The use of pins to hold elastic to cloth may tend to the elastic's useful life, or may tend to tear the material to which the elastic is temporarily held by those pins.

Having described in detail the preferred embodiment of my invention, what I desire to claim and protect by Letters Patent is:

1. A sewing device for sewing elastic to cloth, said device comprising a pair of fingers spaced one from the other, a slide bar connected to each of said fingers, each slide bar and finger defining a generally L-shaped configuration, said slide bars being received in telescoped relation one with the other for adjusting the distance between said fingers, said slide bars being generally positioned in one plane, and said fingers both being generally positioned in another plane, said two separate planes being parallel to but spaced one from the other, a spring loaded pin connected to one end of one slide bars, a series of holes throughout the length of the other of said slide bars, said holes in said other slide bar being on a line generally coaxial with the sliding axis of said slide bars, and said pin and one of said holes being engageable for holding said fingers in the desired spaced relation relative one to the other, and a pair of spring clips, each of said clips being removably connectable with one of said fingers, each of said spring clips being adapted to hold elastic to a finger when said elastic is in the unstretched attitude, as well as when it is in a stretched attitude, without piercing said elastic.

2. A sewing device as set forth in claim 1, said spring-loaded pin comprising a leaf spring connected to said one slide bar, said pin being connected to the other end of said spring, and a hole in that one slide bar through which said pin extends, thereby providing structural protection for said pin and spring.

3. A sewing device as set forth in claim 1, said other slide bar comprising a notch at the free end thereof, said notch cooperating with said pin for aid in introducing said two slide bars in telescoped relation one with the other.

* * * * *